US011072931B2

(12) United States Patent
Jones

(10) Patent No.: US 11,072,931 B2
(45) Date of Patent: Jul. 27, 2021

(54) COVE BASE WITH CHANNEL FOR SEALANT

(71) Applicant: Larry Jones, Orient, OH (US)

(72) Inventor: Larry Jones, Orient, OH (US)

( * ) Notice: Subject to any disclaimer, the term of this patent is extended or adjusted under 35 U.S.C. 154(b) by 0 days.

(21) Appl. No.: 16/214,545

(22) Filed: Dec. 10, 2018

(65) Prior Publication Data

US 2020/0149294 A1 May 14, 2020

Related U.S. Application Data

(63) Continuation-in-part of application No. 16/185,261, filed on Nov. 9, 2018, now Pat. No. 10,655,344.

(51) Int. Cl.
*E04F 19/04* (2006.01)
*E04F 19/06* (2006.01)

(52) U.S. Cl.
CPC ..... *E04F 19/045* (2013.01); *E04F 19/0477* (2013.01); *E04F 19/061* (2013.01); *E04F 2019/044* (2013.01)

(58) Field of Classification Search
CPC . E04F 19/04; E04F 19/049; E04F 2019/0413; E04F 2019/0422; E04F 19/0463; E04F 19/0468; E04F 19/044; E04F 19/061; E04F 19/0477; E04F 19/045; H02G 3/0425
USPC ..... 52/287.1, 288.1, 290
See application file for complete search history.

(56) References Cited

U.S. PATENT DOCUMENTS 1,585,960 A * 5/1926 Baum ..... E04F 19/0495 52/288.1
1,722,660 A * 7/1929 Connelly ..... A47G 27/0456 52/288.1
2,178,501 A * 10/1939 Staneampiano ..... E04F 19/045 52/288.1
2,230,688 A * 2/1941 Irwin ..... E01C 11/106 404/65
3,201,909 A * 8/1965 Heinrich ..... E04F 19/0463 52/288.1
3,222,837 A * 12/1965 Daley ..... A47K 3/008 52/287.1
3,449,873 A * 6/1969 Zittler ..... E04F 19/0495 52/127.12
4,319,528 A * 3/1982 Gutridge ..... B61D 17/08 105/329.1
4,411,112 A * 10/1983 Golden ..... E04B 1/6803 404/65

(Continued)

OTHER PUBLICATIONS tarkettna.com, TightLock Wall Base Systems webpage, Nov. 19, 2018, 1 page.

(Continued)

*Primary Examiner* — Brent W Herring
(74) *Attorney, Agent, or Firm* — Standley Law Group LLP; Jeffrey S. Standley; Adam J. Smith

(57) ABSTRACT

A wall base for sealing a gap between a wall and a floor is provided. The wall base comprises a base member configured to extend along a portion of the wall. A shoe protrusion extends at an angle from the base member and is configured to extend towards the floor and away from the wall. A heel portion extends from the shoe protrusion and is configured to contact the floor. A channel configured to receive the sealant is defined by the space between the heel portion and the shoe protrusion.

12 Claims, 5 Drawing Sheets

(56) References Cited

U.S. PATENT DOCUMENTS 4,829,731 A * 5/1989 Schluter ..... E04F 19/049 52/287.1
5,010,703 A * 4/1991 Pearlman ..... A47G 27/0456 52/273
5,212,923 A 5/1993 Pelosi et al.
5,367,842 A * 11/1994 Janesky ..... E04B 1/7023 52/169.5
5,598,681 A * 2/1997 DiGianni ..... H02G 3/0425 52/288.1
6,189,276 B1 * 2/2001 Pinto ..... E04F 19/04 52/287.1
6,282,855 B1 * 9/2001 Shipton ..... E04F 19/045 52/287.1
6,324,799 B1 * 12/2001 Salvitti ..... E04F 19/045 52/287.1
6,802,161 B1 * 10/2004 Robinson ..... A47K 3/008 52/287.1
7,404,272 B2 7/2008 Piche
7,703,249 B2 * 4/2010 Rachak ..... E04F 19/04 52/288.1
7,797,900 B2 * 9/2010 Sondermann ..... E04F 19/062 52/287.1
8,572,919 B1 * 11/2013 Neill ..... E04F 19/061 52/466
8,729,408 B2 * 5/2014 Pawlak ..... E04F 19/04 174/504
8,973,321 B2 * 3/2015 Pelosi ..... E04F 13/0733 52/287.1
8,997,414 B2 4/2015 Fletcher
9,464,429 B2 * 10/2016 Johnson ..... A47K 3/008
9,970,202 B2 * 5/2018 Kimel ..... E04F 19/045
2008/0005986 A1 * 1/2008 Thompson ..... E04B 2/82 52/290
2008/0134602 A1 * 6/2008 Schick ..... E04F 19/0486 52/287.1
2010/0186329 A1 * 7/2010 Buys ..... A47B 77/022 52/288.1
2011/0108318 A1 * 5/2011 Pawlak ..... E04F 19/04 174/504
2014/0137496 A1 * 5/2014 Fletcher ..... F16J 15/14 52/287.1
2015/0252561 A1 * 9/2015 Johnson ..... A47K 3/008 52/272
2016/0215508 A1 * 7/2016 Kimel ..... E04F 19/0477

OTHER PUBLICATIONS homedepot.com, Cove Base search results webpage, Nov. 9, 2018, 3 pages.
Speedcove, Inc. d.b.A Solid Rock Enterprises, SpeedCove webpage (www.speedcove.com), Oct. 29, 2018, 4 pages.
Easycove, www.easycove.com webpage, Oct. 29, 2018, 4 pages.
Rocktred, Easycove, https://rocktred.com/easycove.php, Oct. 22, 2018, 5 pages.
Diybasement Youtube Page, How to Seal a Wet Basment Watertight, https://www.youtube.com/watch?time_continue=74&v=N1vu0F6ggOA, Sep. 22, 2017, 1 page.
waterproof.com, SealOnce Basement System webpage, https://waterproof.com/products/sealonce-basement-system-main-section/, Oct. 16, 2018.
Larry Jones, photos of Existing Baseboards, Oct. 22, 2018.

* cited by examiner

COVE BASE WITH CHANNEL FOR SEALANT

CROSS-REFERENCE TO RELATED APPLICATION

This application is a continuation-in-part of U.S. application Ser. No. 16/185,261 filed Nov. 9, 2018, the disclosures of which are hereby incorporated by reference as if restated fully herein.

TECHNICAL FIELD

Exemplary embodiments of the present invention relate generally to a cove base with a channel for receiving a sealant.

BACKGROUND AND SUMMARY OF THE INVENTION

Wall base is a trim item used for decorative and functional purposes. Wall base is typically positioned at the bottom of a wall where the wall meets the floor. The wall base provides a decorative element and also serves to cover the otherwise unsightly meeting of the wall and the floor. Sometimes, the wall base is secured to the wall by nails or other fasteners. Other times, the wall base is secured to the wall by way of an adhesive. In many cases, installation of the wall base results in various size and shape gaps between the wall base and the floor. Sometimes such gaps are caused by uneven floors. Other times, such gaps appear over time as the building shifts and settles.

An improper seal between the wall base and the wall or floor can be problematic in many environments. For example, without limitation, hospitals and other medical care facilities often treat patients who may expel bodily fluids on the floor. When cleaning, excess fluids may be inadvertently forced into such gaps between the wall base and the floor or wall. The lingering presence of fluids may promote the growth and release of bacteria and other germs into the surrounding environment. A similar experience may be found with restrooms. Even in more common applications such as but not limited to a home or business, moisture may leak into such gaps resulting in mold, bacteria growth, rust, and the like.

Sometimes a sealant may be provided on or around the wall base to further secure the wall base in position and/or to seal such gaps. However, it is difficult to provide the even and consistent bead of sealant along a wall base required to maintain an aesthetically pleasing appearance and proper seal. The terms "wall base", "cove base", "base moulding", "base moulding strip", etc., are but a few of the commercial terms used for such products, which are known to those of ordinary skill in the art of building construction and are used interchangeably herein to have the same general meaning. Often times, cove bases are comprised of a flexible type material, which makes the application of a sealant particularly difficult. To further complicate matters, cove bases may comprise a shoe portion which extends away from the wall to the floor and a bottom edge which contacts the floor. The addition of such features may make application of a sealant even more difficult.

Therefore, what is needed is a cove base with a channel for receiving a sealant. The present invention is cove base with a channel for receiving a sealant.

A portion of the cove base described as an elongate base member may be configured to extend along parallel to the wall when installed. Another portion described as a shoe protrusion may extend outward from the wall at an angle from the wall when installed. The shoe protrusion may be configured to extend downward and may include a radius angle which extends away from the wall. A heel may extend from the shoe protrusion and may be configured to contact the floor. The space between the heel portion, the shoe protrusion, and the floor may define a channel for the sealant when installed. The heel portion may be substantially cylindrical in shape, though any shape and size is contemplated. The heel portion may extend towards the base.

Further features and advantages of the devices and systems disclosed herein, as well as the structure and operation of various aspects of the present disclosure, are described in detail below with reference to the accompanying figures.

BRIEF DESCRIPTION OF THE DRAWINGS

In addition to the features mentioned above, other aspects of the present invention will be readily apparent from the following descriptions of the drawings and exemplary embodiments, wherein like reference numerals across the several views refer to identical or equivalent features, and wherein.

DETAILED DESCRIPTION OF EXEMPLARY EMBODIMENT(S)

Various embodiments of the present invention will now be described in detail with reference to the accompanying drawings. In the following description, specific details such as detailed configuration and components are merely provided to assist the overall understanding of these embodiments of the present invention. Therefore, it should be apparent to those skilled in the art that various changes and modifications of the embodiments described herein can be made without departing from the scope and spirit of the present invention. In addition, descriptions of well-known functions and constructions are omitted for clarity and conciseness.

Embodiments of the invention are described herein with reference to illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing.

Figure 1:
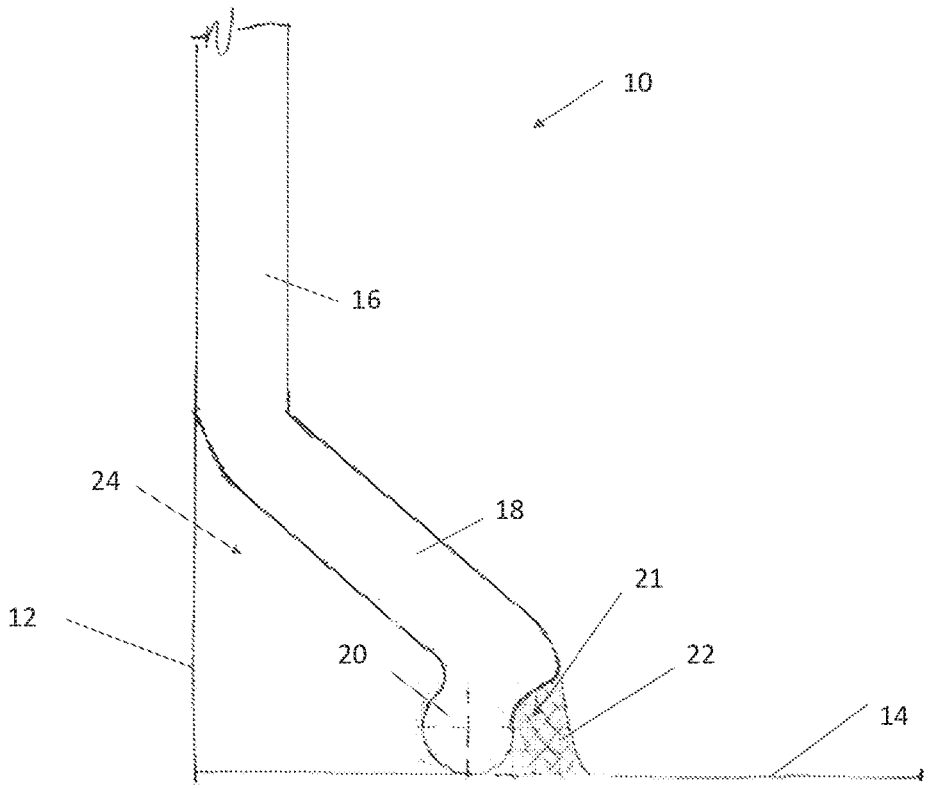
FIG. 1 is a side sectional view of an exemplary cove base in accordance with the present invention.

FIG. 1 is a side sectional view of an exemplary cove base 10. The cove base 10 may comprise an elongate base member 16. The base member 16 may extend in a substantially vertical direction. The base member 16 may be configured to extend along a portion of a wall 12 when installed. The wall 12 may be comprised of drywall, metal, wood, vinyl, some combination thereof, or the like. Any wall 12 material is contemplated. The wall base 10 may further comprise a shoe protrusion 18. The shoe protrusion 18 may extend at an angle from the base member 16. The shoe 16 may be configured to extend away from the wall 12 and towards a floor 14 when installed. Any angle is contemplated. The floor 14 may be the ground or a raised floor such as, but not limited to, vct, tile, vinyl, linoleum, hardwood, artificial wood, concrete, some combination thereof, or the like. A cavity 24 may be formed between the shoe protrusion 18, a heel portion 20, the wall 12, and the floor 14 when installed. In exemplary embodiments, the floor 14 may be installed before the cove base 10 is installed, though such is not required.

The heel portion 20 may extend from the shoe protrusion 18. The heel portion 20 may be configured to extend to the floor 14 when installed. In exemplary embodiments, the heel portion 20 may be substantially cylindrical in shape and extend along the shoe protrusion 18 such that the heel portion 20 comprises a substantially circular cross section when viewed from the side. It is contemplated that the heel portion 20 may be any size and shape. The heel portion 20 may comprise any size and shape cross section. Furthermore, the size and shape of the heel portion 20 may vary. The heel portion 20, for example without limitation, may be any straight line or curved shape for receiving a sealant 22. In exemplary embodiments, the floor 14 may be configured to provide a proper or seal when placed into contact with the sealant 22. For example, without limitation, the floor 14 may be comprised of a hard, rigid, or semi-rigid material.

In exemplary embodiments, the heel portion 20 may extend towards the base member 16 relative to the front edge of the shoe protrusion 18. In other exemplary embodiments, the heel portion 20 may be located a distance towards the base member 16 relative to the front edge of the shoe protrusion 18. Stated another way, the heel portion 20 may extend towards, or be located a distance towards, the wall 12 when installed. A channel 21 may be defined by the space between a lower edge of the shoe protrusion 18 and a front surface of the heel portion 20. The channel 21 may be configured to receive the sealant 22. The sealant 22 may be placed within the channel 21 and may be used to provide a sealed connection between the cove base 10 and the floor 14 when installed. More specifically, in exemplary embodiments, the channel 21 may be defined by the space between the lower edge of the shoe, the front surface of the heel portion 20, and an upper surface of the floor 14 when installed.

The channel 21 may be configured to receive a sealant 22. The sealant 22 may be any kind of sealant, such as but not limited to, caulk, adhesive, epoxy, urethane, wax, polyurea, some combination thereof, or the like. The sealant 22 may be placed in the channel 21 before or after the channel 21 is placed into contact with the floor 14.

The cove base 10 may be comprised of rigid or flexible materials. The cove base 10, including the base member 16, the shoe protrusion 18, and the heel portion 20, may be comprised of a rubber, plastic, polymer, vinyl, wood, metal, thermoplastic, vulcanized thermoset, some combination thereof, or the like. The various components of the base moulding 10, such as the base member 16, the shoe protrusion 18, and the heel portion 20, may be comprised of the same or different materials.

Installation of the wall base 10 may be performed by cutting the cove base 10 to a specified length. In other exemplary embodiments, the cove base 10 may be received in a predetermined size such that cutting is not required. Adhesive may be placed along the rear surface of the base member 16 and/or along a corresponding section of the wall 12. The base member 16 may be placed in contact with the wall 12 and the adhesive may be allowed to cure. Alternatively, or in addition, fasteners may be driven though the base member 16 to secure the base member 16 to the wall 12. The base member 16 may be secured against the wall 12 such that the heel portion 20 contacts the floor 14. A layer of sealant 22 may be provided within the cavity 21 such that the sealant 22 is in contact with the heel portion 20 and the floor 14. Alternatively, in or in addition, the layer of sealant 22 may be provided along the floor 14 and the cove base 10 may be positioned such that the sealant 22 fills the cavity 21. Regardless, the sealant 22 may be smoothed. Excess sealant 22 may be removed. The sealant 22 may be allowed to cure.

In exemplary embodiments, an existing cove base 10 may be modified to form a channel 21 configured to receive the sealant 22.

Figure 2:
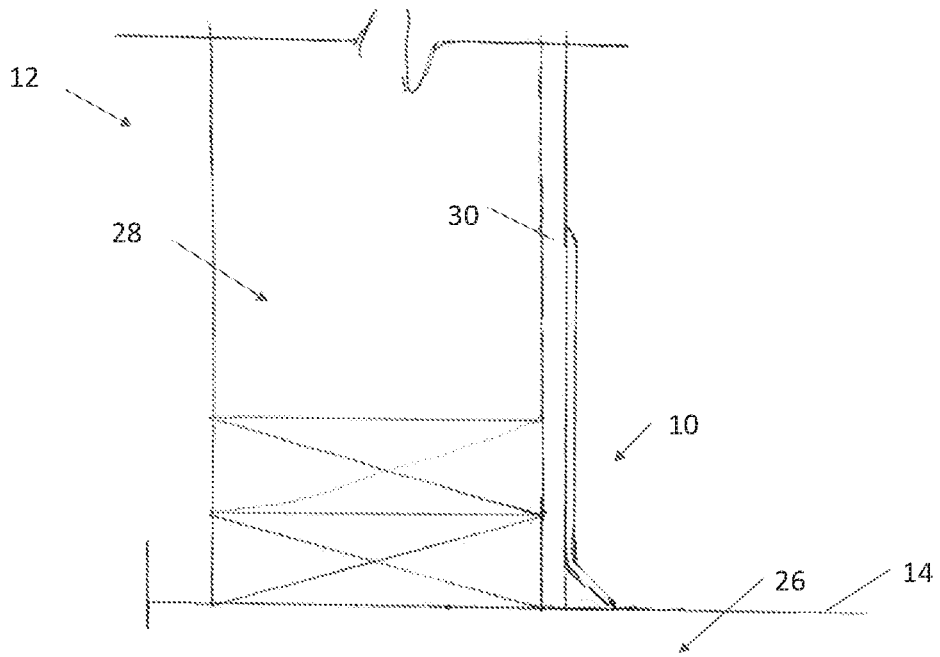
FIG. 2 is a side sectional view of an exemplary installed cove base.

FIG. 2 is a side sectional view of an exemplary installed cove base 10. A firestop 28 may be provided within the wall 12. A drywall section 30 may be located between the firestop 28 and base moulding 10. The cove base 10 may extend over some or all of the drywall section 30. Concrete or another foundation material 26 may be provided below the floor 14. It is notable that the entire floor 14 may not be level such that periodic gaps or various shapes and sizes may occur between the wall 12 and the floor 14. The cove base 10 may be used, in part, to cover these gaps. However, these gaps can provide a space for bacteria, mold, insects, moisture, and the like. The use of a sealant 22 between the cove base 10 and the floor 14 may provide a proper seal to help prevent, or eliminate, the existence of bacteria, mold, insects, moisture, and the like. The channel 21 may provide a convenient and efficient space for a bead of the sealant 22 to be placed between the cove base 10 and the floor 14 when installed.

Figure 3:
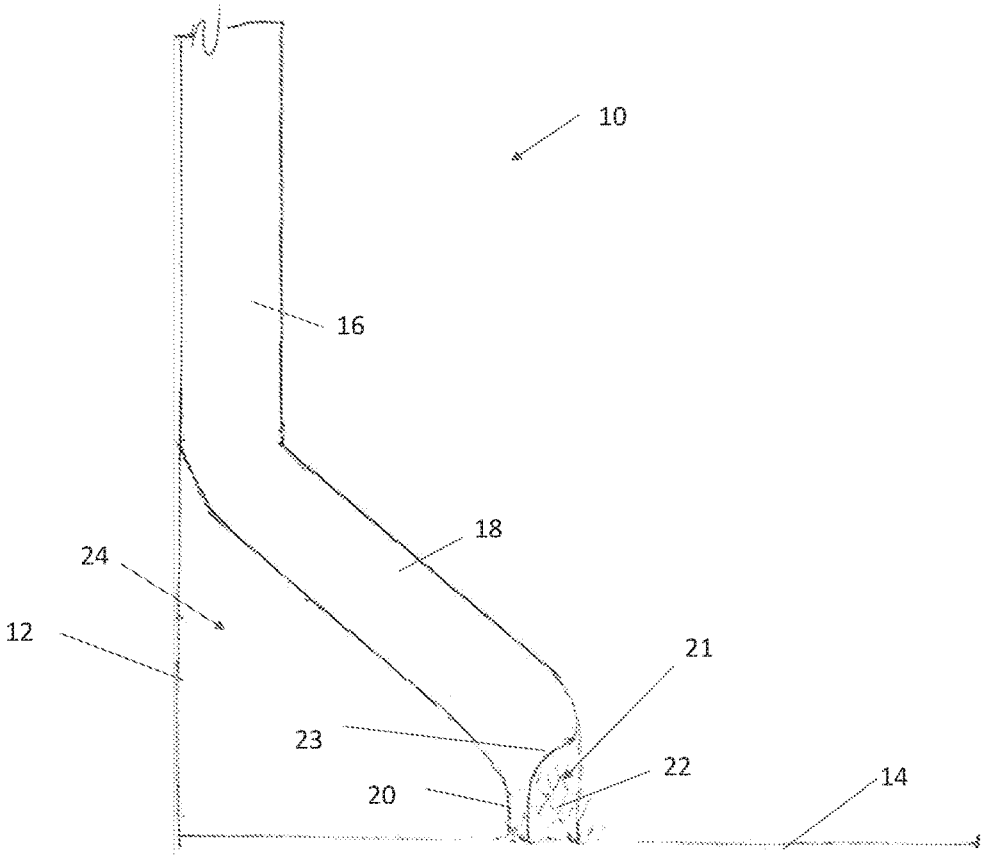
FIG. 3 is a side sectional view of another exemplary embodiment of the cove base.

FIG. 3 is a side sectional view of another exemplary embodiment of the wall base 10. The heel portion 20 may comprise a curved section 23 which may extend from the floor 14 to the shoe protrusion 18, when installed, to define a substantially concave shaped channel 21 for the sealant 22. Stated another way, the heel portion 20 may be understood as a protrusion extending downward from the shoe protrusion 18 to the floor 14, when installed, and the channel 21 may comprise a substantially quarter circle shaped recess within the heel portion 20 located along a front edge thereof and configured to receive a bead of the sealant 22. However, any size and shape channel 21 is contemplated and the channel 21 may vary in size and shape across one or more cove bases 10.

Figure 4:
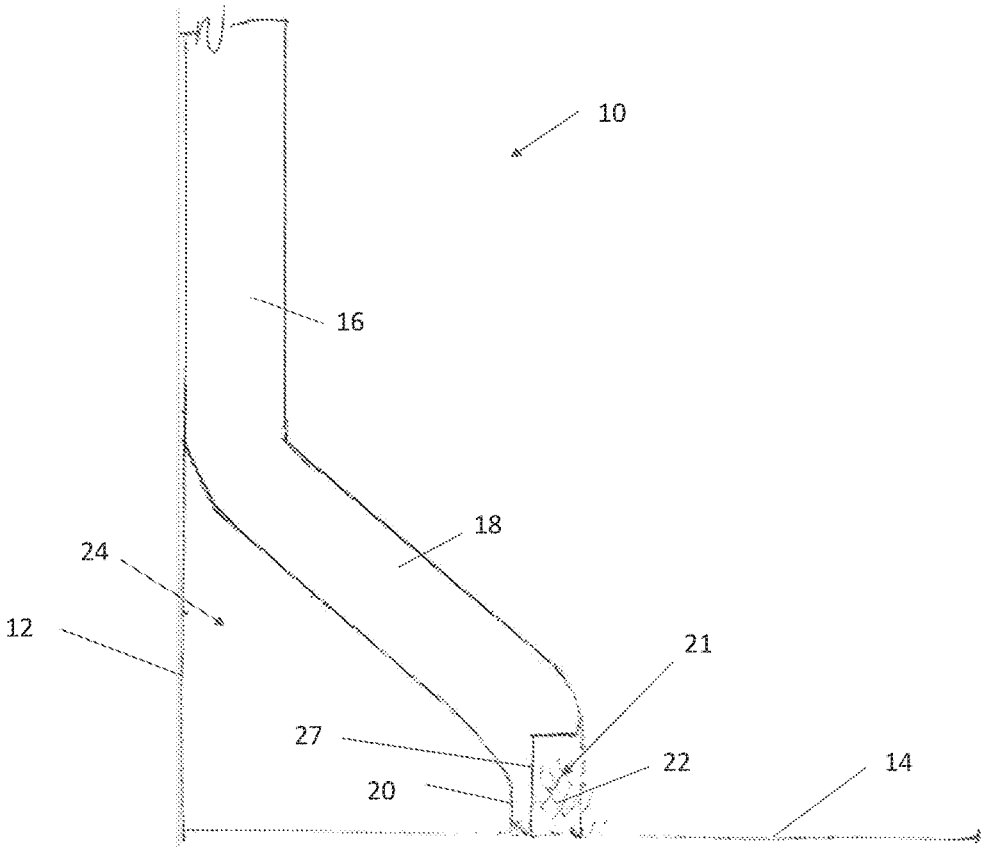
FIG. 4 is a side sectional view of another exemplary embodiment of the cove base.

FIG. 4 is a side sectional view of another exemplary embodiment of the cove base 10. The heel portion 20 may comprise a notched recess 27 which may extend vertically upwards from the floor 14, when installed, and horizontally to a front end of the shoe protrusion 18. Stated another way, the heel portion 20 may be understood as a protrusion extending downward from the shoe protrusion 18 to the floor 14, when installed. The channel 21 may comprise a substantially rectangular or square shaped opening within the heel portion 20 and located along a front edge thereof configured to receive a bead of the sealant 22. However, any size and shape channel 21 is contemplated and the channel 21 may vary in size and shape across one or more cove bases 10. In exemplary embodiments, without limitation, the notched recess 27 may be less than ¼ of an inch in height and less than ¼ of an inch in depth, though any size is contemplated. In other exemplary embodiments, without limitation, the channel 21 may be less than ¼ of an inch in height and less than ¼ of an inch in depth or have a radius of less than ¼ of an inch, though any size is contemplated.

Figure 5:
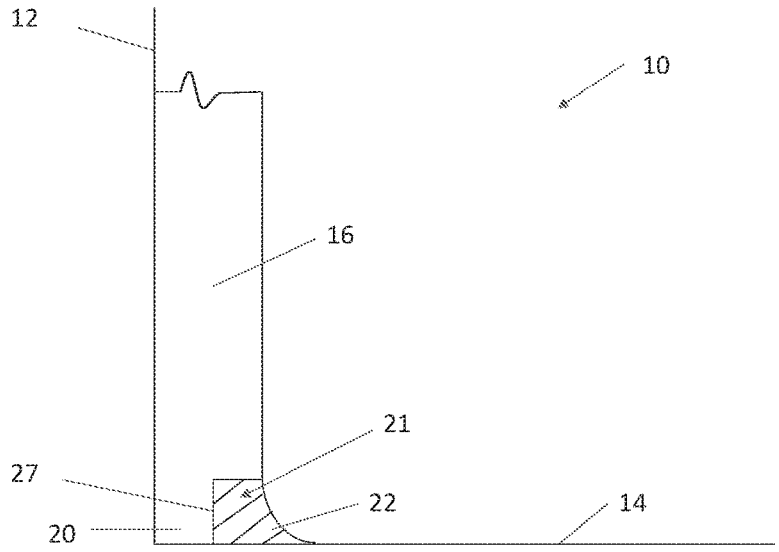
FIG. 5 is a side sectional view of another exemplary embodiment of the cove base.

FIG. 5 is a side sectional view of another exemplary embodiment of the cove base 10. The cove base 10 may be similar to the cove base 10 shown and described in FIG. 4 however the base member 16 may extend vertically to the floor. The shoe protrusion 18 may not be required or may extend from the base member 16 in a substantially straight line to the floor 14. The heel portion 20 may not be require or may extend from the base member 16 or the shoe protrusion 18 in a substantially straight line to the floor 14.

Any of the wall bases 10 described herein may be comprised of any material, rigid or flexible. Any of the cove bases 10 described herein may comprise a shoe protrusion 18 or not. Furthermore, the use of a heel portion 20 is optional in all shown and described embodiments.

Any embodiment of the present invention may include any of the optional or preferred features of the other embodiments of the present invention. The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to the described invention. Many of those variations and modifications will provide the same result and fall within the spirit of the claimed invention. It is the intention, therefore, to limit the invention only as indicated by the scope of the claims.

What is claimed is:

1. A wall base for use where a wall meets a floor, the wall base comprising:

an elongate base member comprising:

(a) a back surface, wherein at least a substantial portion of said back surface is adapted to be affixed to a lower region of an exposed side of an internal wall of a structure such that, when affixed, said base member covers a portion of the exposed wall over which the base member is affixed;

(b) an opposing protective front surface, wherein at least a majority of said front surface is adapted to be exposed and to protect said internal wall when affixed to said internal wall;

(c) a top edge configured, when installed, to run laterally along the wall; and, (d) a bottom edge configured to contact the floor when installed, wherein a distance halfway between said top edge and said bottom edge defines upper and lower halves of said base member;

an extension member extending downward from, and forward of, said front surface of said base member at a location at or above the bottom edge and from within the lower half of said base member, said extension member having an extension member forward surface positioned forward of the bottom edge of the base member;

a protrusion extending downward from a distal, lower portion of the extension member and terminating to form said bottom edge, thereby forming a channel for receiving sealant, said channel defined by a unitary, continuous front surface of said protrusion, said lower surface of said extension member forward surface, and said floor;

wherein said channel extends substantially the length of said base member, under the extension member forward surface and the channel is backstopped by the front surface of the protrusion, and the channel is configured to receive sealant material after said back surface is affixed to said wall wherein said channel is configured such that, when said wall base is placed in an installed position, the channel is configured to place the sealant in engagement with the floor, an underside of the extension member, and the front surface of the protrusion.

2. The wall base of claim 1 wherein:

the base member and the extension member are formed together as one unitary part.

3. The wall base of claim 1 wherein:

the front surface of said protrusion is curved.

4. The wall base of claim 1 wherein:

the base member, and the extension member, are comprised of a flexible material.

5. The wall base of claim 1 wherein:

the base member, and the extension member are comprised of a material selected from the group consisting of: rubber, plastic, polymer, vinyl, wood, metal, thermoplastic, vulcanized thermoset.

6. The wall base of claim 1 wherein:

the sealant material is a material selected from the group consisting of: adhesive, epoxy, urethane, wax, polyurea.

7. The wall base of claim 1 wherein:

said extension member forward surface comprises a material that is sufficiently flexible to permit said lower surface of said extension member forward surface to be lifted up to insert the sealant material into said channel, and then pressed back down on the sealant material once the sealant material is added to said channel.

8. The wall base of claim 1 wherein:

said protrusion is spaced apart from, and does not contact, said wall when said wall base is installed.

9. The wall base of claim 1 wherein:

said back surface is flat to receive an adhesive for securing said back surface to said lower region of said exposed side of said internal wall of said structure.

10. The wall base of claim 1 wherein:

said protrusion extends directly downward.

11. The wall base of claim 1 wherein:

said unitary, continuous front surface of said protrusion extends from said lower surface of said extension member forward surface to said floor.

12. A wall base for providing a sealed connection between an interior wall and a floor comprising:

a base member comprising:

a rear surface configured to receive an adhesive and be installed along an outer surface of the interior wall at an elevated position above the floor such that a lower edge of said base member is located above the floor when said wall base member is installed; and a protective front surface opposing said rear surface;

a shoe portion extending at an angle from a lower half of the base member and configured to extend away from the outer surface of the interior wall and towards the floor, but not touch the floor, when said wall base is installed;

a heel portion extending downward from a lower portion of the shoe portion and configured to abut at least a portion of the floor when said wall base is installed; and a channel adapted to receive a bead of the sealant, wherein said channel is defined in part by a front edge of the heel portion which forms a backstop for said channel, wherein said channel is adapted to remain exposed to a user for receipt of said sealant when said wall base is installed, and wherein said channel maintains the same vertical height or decreases in vertical height from an entrance of said channel to the front edge of said heel portion;

wherein the channel comprises a curved edge extending downward from a lower edge of the shoe portion along the front edge of the heel portion so as to form a concave recess which decreases in vertical height from the entrance of said channel to the front edge of said heel portion.

* * * * *